US007097325B2

(12) United States Patent
Wu

(10) Patent No.: US 7,097,325 B2
(45) Date of Patent: Aug. 29, 2006

(54) EASILY DETACHABLE LAMP ASSEMBLED DEVICE

(76) Inventor: Wen-Chang Wu, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/410,816

(22) Filed: Apr. 11, 2003

(65) Prior Publication Data

US 2004/0201986 A1 Oct. 14, 2004

(51) Int. Cl.
*H01R 33/00* (2006.01)
*F21V 21/00* (2006.01)

(52) U.S. Cl. ..... 362/226; 362/382; 362/391

(58) Field of Classification Search ..... 362/226, 362/382, 249, 362, 389, 391, 368, 406, 217, 362/433, 435, 439; 403/321, 322.2
See application file for complete search history.

(56) References Cited

U.S. PATENT DOCUMENTS 6,565,240 B1 * 5/2003 Wu ..... 362/405
6,612,531 B1 * 9/2003 Wu ..... 248/317
6,715,906 B1 * 4/2004 Wu ..... 362/405
2004/0080935 A1 * 4/2004 Wu ..... 362/226

* cited by examiner

*Primary Examiner*—Thomas M. Sember
*Assistant Examiner*—Bao Q. Truong

(57) ABSTRACT

A detachable lamp assembled device comprises a lamp seat secured to a wire winding box, and a lamp rod. A top of the lamp seat is protruded with a connecting seat and a receiving hole is formed in the connecting seat for locating a limiting structure. The limiting structure is formed by a buckling lock at a lowermost side of the receiving hole. An elastomer is above the buckling pin, and a positioning plate is locking above the connecting seat by a first stud. In another case, a buckling hole is formed in the lamp seat and penetrated two sides of the lamp seat. A buckling pin is placed in the buckling hole. A reed is locked below the buckling hole by a first stud and one free end of the reed is inserted into the buckling hole. Thereby, the buckling pin is limited in the buckling hole.

8 Claims, 5 Drawing Sheets

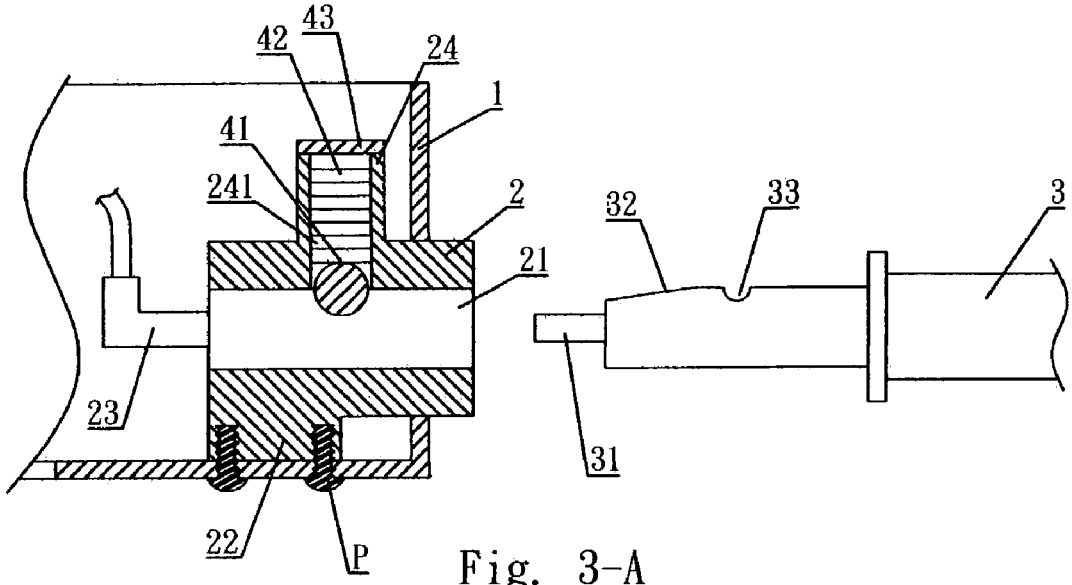
Fig. 3-A
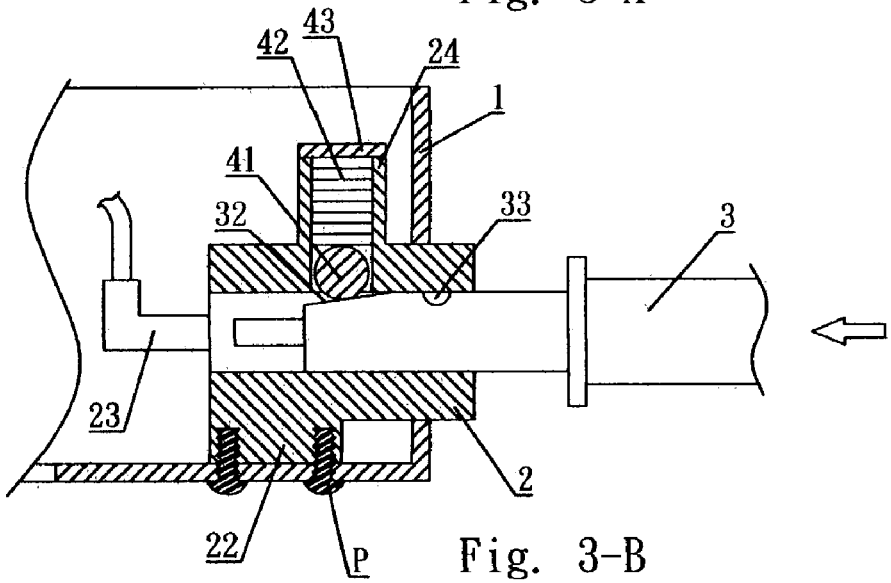
Fig. 3-B
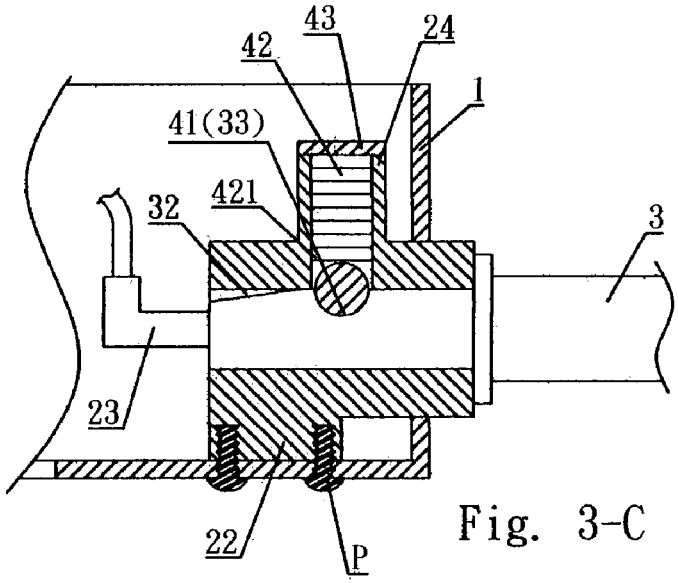
Fig. 3-C

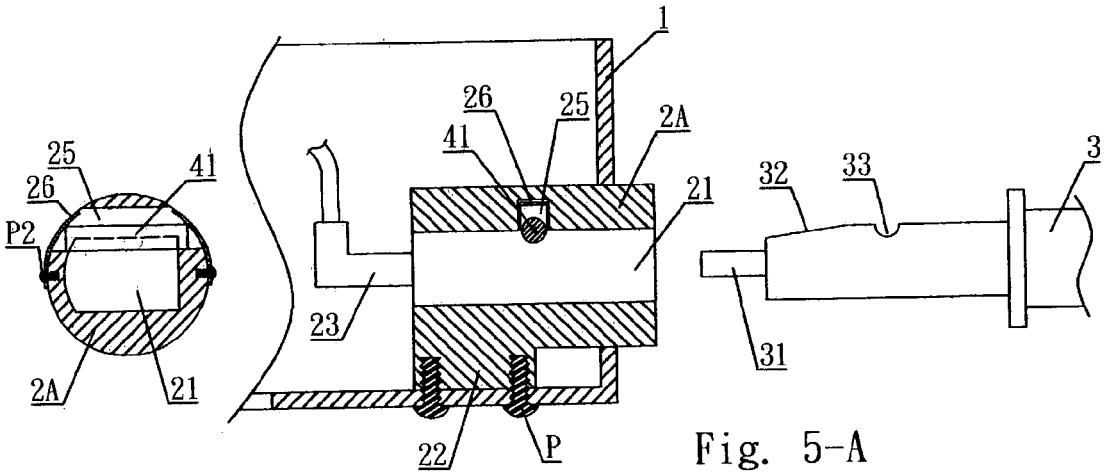
Fig. 5-A
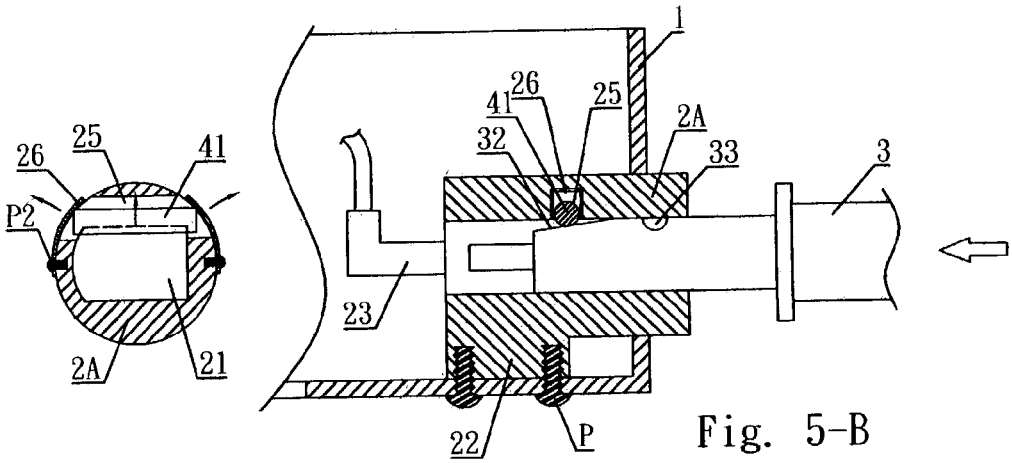
Fig. 5-B
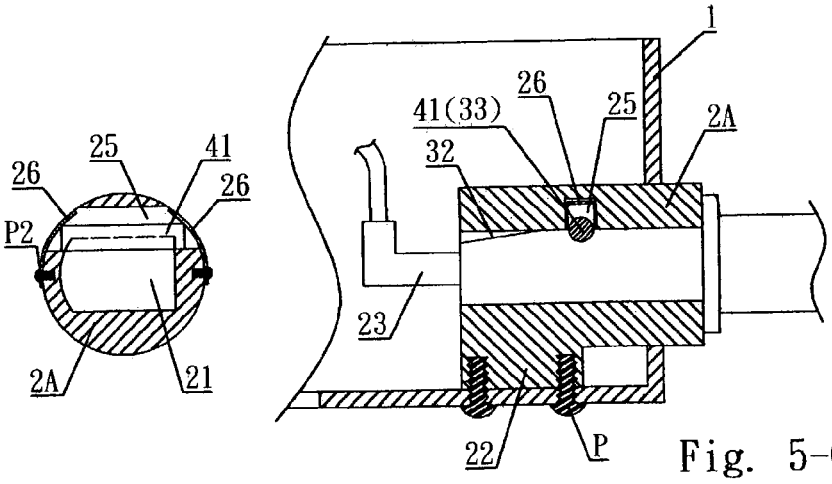
Fig. 5-C

EASILY DETACHABLE LAMP ASSEMBLED DEVICE

BACKGROUND OF THE INVENTION

The present invention relates to lamp assembly devices, and particularly to an easily detachable lamp assembled device. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easily occur, but also the locking tools (for example, spanners, openers, etc.) are necessarily used in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a detachable lamp assembled device comprising a lamp seat secured to a wire winding box, and a lamp rod. A top of the lamp seat is protruded with a connecting seat and a receiving hole is formed in the connecting seat for locating a limiting structure. The limiting structure is formed by a buckling lock at a lowermost side of the receiving hole. An elastomer is above the buckling pin, and a positioning plate is locking above the connecting seat by a first stud. In another case, a buckling hole is formed in the lamp seat and penetrated two sides of the lamp seat. A buckling pin is placed in the buckling hole. A reed is locked below the buckling hole by a first stud and one free end of the reed is inserted into the buckling hole. Thereby, the buckling pin is limited, in the buckling hole.

The various objects and advantages of the present invention will be more readily understood from the following detailed description when read in conjunction with the appended drawing.

BRIEF DESCRIPTION OF THE DRAWINGS

FIG. 3A shows one embodiment of the present invention before the insertion of the lamp rod.

FIG. 3B shows the embodiment of FIG. 3A wherein the lamp, rod is inserting.

FIG. 3C shows the embodiment of FIG. 3A after the insertion of the lamp rod.

FIG. 5A shows the embodiment of FIG. 4 before the insertion of the lamp rod.

FIG. 5B shows the embodiment of FIG. 4 wherein the lamp rod is inserting.

FIG. 5C shows the embodiment of FIG. 4 after the insertion of the lamp rod.

BRIEF DESCRIPTION OF THE PREFERRED EMBODIMENTS

Figure 1:
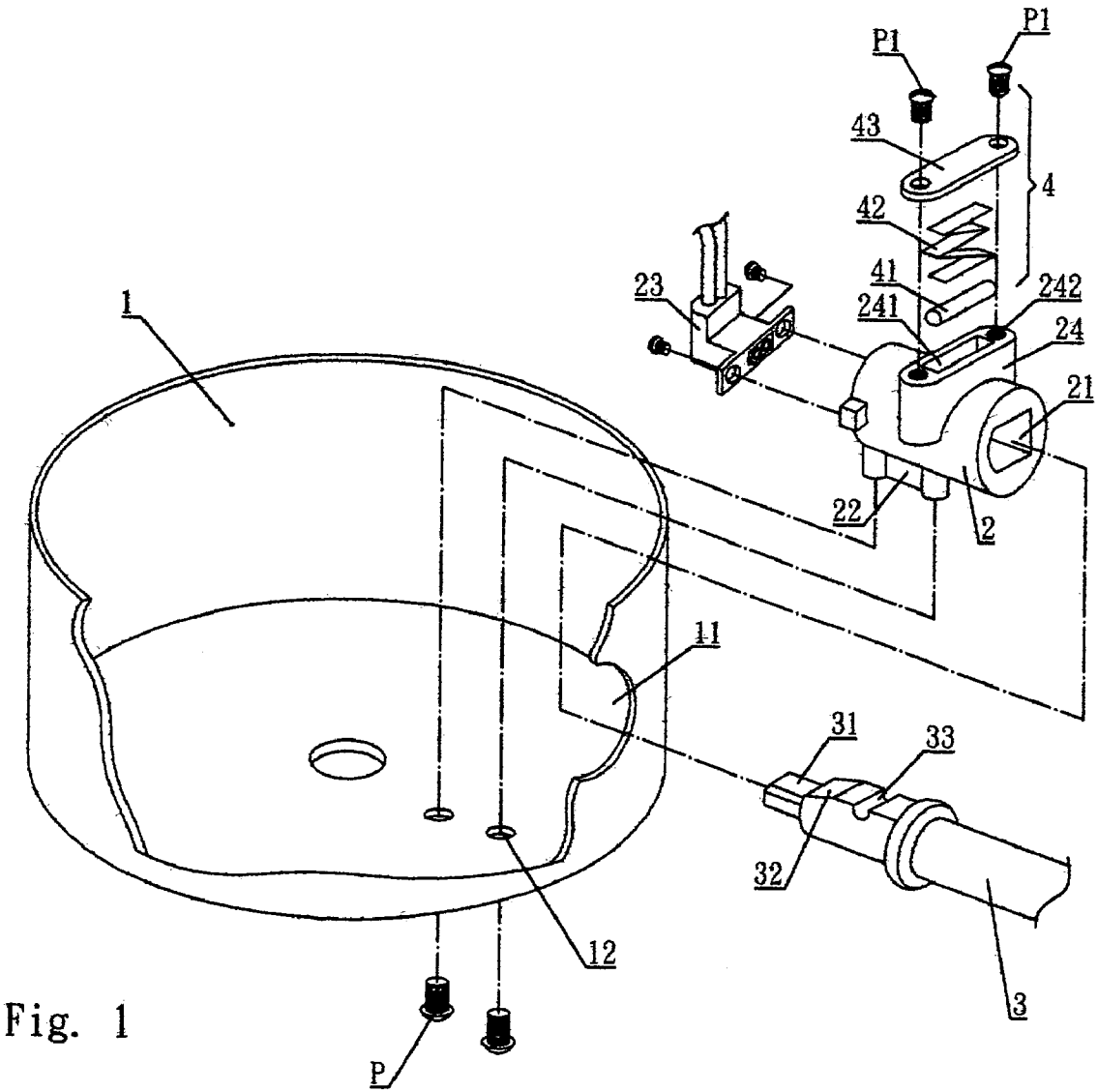
FIG. 1 is an exploded perspective view of the present invention.
Figure 2:
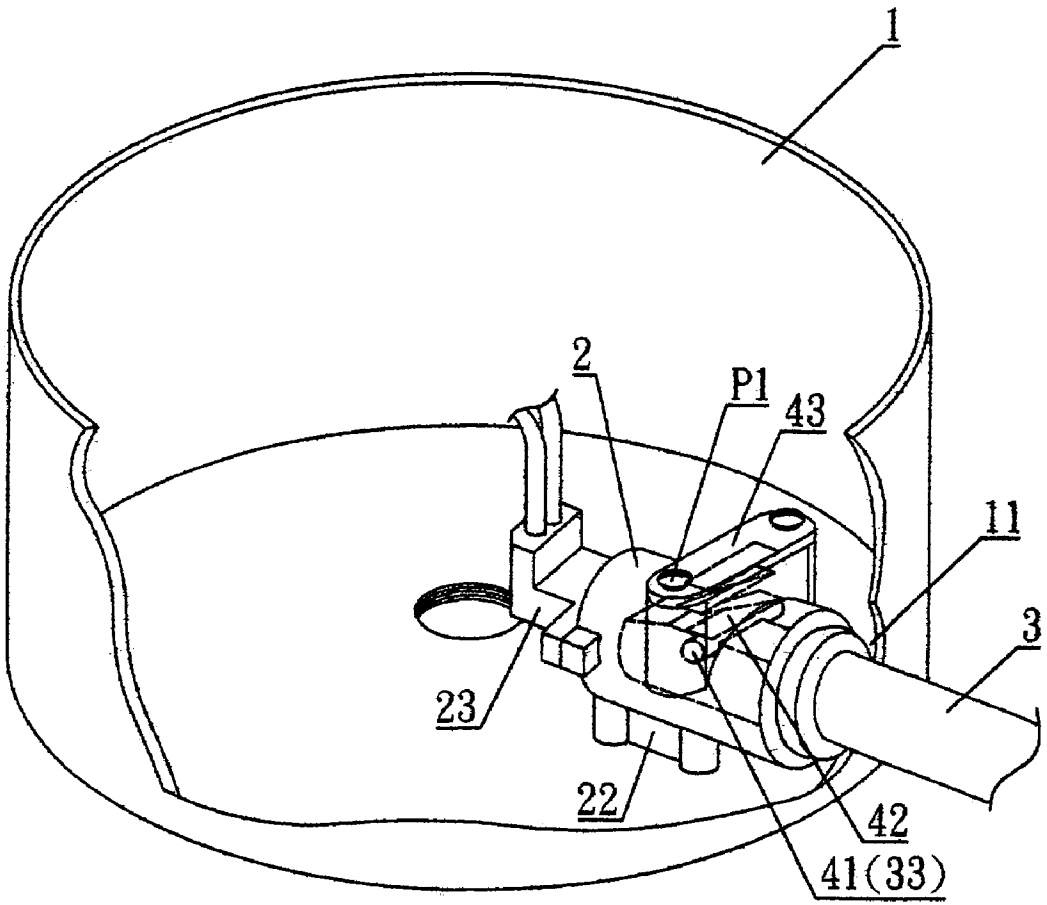
FIG. 2 is an assembled perspective view of the present invention.

Referring to FIGS. 1 and 2, the device of the present invention is illustrated. The present invention includes a lamp seat 2 firmly secured to a lateral side of a wire winding box 1, and a lamp rod 3 inserted into the lamp seat 2.

A lateral side of the wire winding box 1 has a via hole 11 and a bottom of the wire winding box 1 coupled to the lamp seat 2 has through holes 12 for being passed by studs P so as to lock the lamp seat 2 to a predetermined positioned.

A portion of the lamp seat 2 coupled to the via hole 11 of the wire winding box 1 has a penetrating hole 21 and a bottom of the lamp seat 2 protruded with a locking seat 22 with a configuration corresponding to the through holes 12 of the wire winding box 1, thereby the studs P can pass through the through hole 12 from a lower end of the wire winding box 1 and then is locked to the locking seat 22 so as to fix the lamp seat 2 to the wire winding box 1. A distal end of the lamp seat 2 is locked with an inserting seat 23 which is exactly resisted by an end portion 31 of the lamp rod 3. A top of the lamp seat 2 is protruded with a connecting seat 24 and a receiving hole 25 is formed in the connecting seat 24 for locating a limiting structure 4.

The limiting structure is formed by a buckling lock 41 at a lowermost side of the receiving hole 241, an elastomer 42 above the buckling pin 41, and a positioning plate 43 locking above the connecting seat 24 by a stud P1. The elastomer 42 is compressed by the positioning plate 43 slightly so as to provide a space for tolerating the compressing of the elastomer 42 in the receiving hole 241.

A front end of the lamp rod 3 is formed with an end portion 31 which can be inserted into the inserting seat 23. After the lamp rod 3 is inserted into the inserting seat 23, the lamp seat 2 is conductive to the lamp rod 3. A portion of the lamp rod 3, near the end portion 31 has an inclined surface 32. Thereby, the end portion 31 can be inserted into the inserting seat 23 easily. Thereby, a top of the lamp rod 3 has a groove 33 for positioning the limiting structure 4.

The operation of the present invention will be described as reference to FIG. 3. At first the lamp rod 3 is inserted into the lamp seat 2. The inclined surface 32 of the lamp rod 3 resists against the buckling pin 41 in the lamp seat 2 and the buckling pin 41 is ejected to compress the elastomer 42 so that the lamp rod 3 can be inserted easily (referring to FIG. 3B). When the lamp rod 3 inserts into the lamp seat 2 continuously until the end portion 31 of the lamp rod 3 inserts into the connecting seat 24 of the lamp seat 2 and the groove 33 is exactly coupled to a lower side of the buckling pin 41 of the lamp seat 2. By the resilient force of the elastomer 42, the buckling pin 41 moves downwards to restore to the original position toy be buckled to the groove 33 of the lamp rod 3 (referring to FIG. 3C). Thereby, the lamp rod 3 is positioned on the lamp rod 3.

Figure 4:
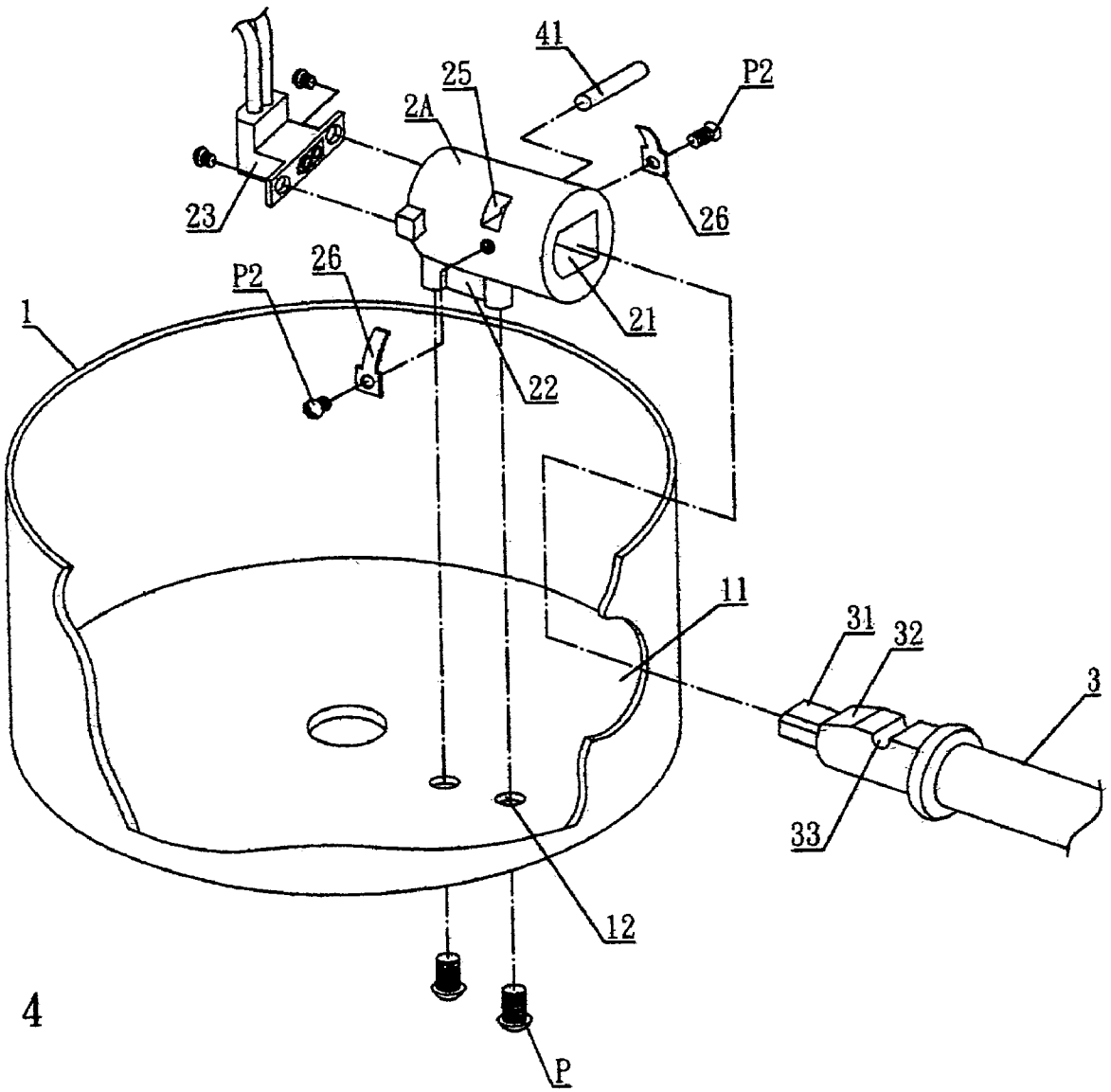
FIG. 4 shows another embodiment of the present invention.

Referring to FIGS. 4 and 5, another embodiment of the present invention is illustrated. A buckling hole 25 is formed in the lamp seat 2 and penetrated two sides of the lamp seat 2A. A buckling pin 41 is placed in the buckling hole 25. A reed 26 is locked below the buckling hole 25 by a stud P2 and one free end of the reed 26 is inserted into the buckling hole 25. Thereby, the buckling pin 41 is limited in the buckling hole 25 so as to position the lamp rod 3.

A front end of the lamp rod 3 has an inclined surface 32. When the lamp rod 3 inserts into the penetrating hole 21 of the lamp seat A2, at first the inclined surface resists against the buckling pin 41 and pushes the buckling pin 41 to move the reed 26 in the buckling hole 25. Thereby, the lamp rod 3 can be inserted into the lamp seat 2 easily (referring to FIG. 5B). When the lamp rod 3 is inserted continuously until the end portion 31 of the lamp rod 3 is further inserted into the inserting seat 23 in the lamp seat 2 and the groove 33 of the lamp rod 3 is aligned to a lower side of the buckling pin 41 of the lamp seat 2A, the buckling pin 41 restores to an original position by the downward resilient force of the reed 26 so as to be exactly buckled to the groove 33 (referring to FIG. 5C). Thereby, the lamp rod 3 is positioned in the lamp seat 2.

By above said structure, in transferring or storage, the lamp rod and the wire winding box 1 can be detached in advance so as to reduce the volume. In use, the user only needs to insert the lamp rod into the lamp seat 2 without using any locking tools. Thus, the user can assemble the lamp by himself (or herself).

Furthermore, in the present invention an upper cover of the wire winding box 1 has a limiting piece extending downwards from the upper cover, and a cambered slot is formed on the wire winding box at a position coupling to the limiting piece; and a lower edge of the limiting piece coupling to the lamp rod has a cambered groove. the upper cover of the wire winding box has a buckling portion extending outwards and capable of being buckled to an edge of the lamp rod when the buckling portion is engaged to the wire winding box. An inner edge of the upper cover is installed with a plurality of blocks which are arranged along an annular shape.

The present invention is thus described, it will be obvious that the same may be varied in many ways. Such variations are not to be regarded as a departure from the spirit and scope of the present invention, and all such modifications as would be obvious, to one skilled in the art are intended to be included within the scope of the following claims.

What is claimed is:

1. A detachable lamp assembled device comprising a lamp seat firmly secured to a lateral side of a wire winding box, and a lamp rod inserted into the lamp seat; wherein a lateral side of the wire winding box having a via hole;

a portion of the lamp seat coupled to the via hole of the wire winding box has a penetrating hole, a distal end of the lamp seat is locked with an inserting seat which is exactly resisted by an end portion of the lamp rod; a top of the lamp seat is protruded with a connecting seat and a receiving hole is formed in the connecting seat for locating a limiting structure;

the limiting structure is formed by a buckling lock at a lowermost side of the receiving hole, an elastomer above the buckling pin, and a positioning plate locking is located above the connecting seat by a first stud; the elastomer is compressed by the positioning plate slightly so as to provide a space for tolerating the compressing of the elastomer in the receiving hole; and a front end of the lamp rod is formed with an end portion for being inserted into the inserting seat, after the lamp rod is inserted, the end portion is inserted into the inserting seat simultaneously; thereby, the lamp seat is conductive to the lamp rod; a portion of the lamp rod near the end portion has an inclined surface; thereby, the end portion can be inserted into the inserting seat easily; thereby, a top of the lamp rod has a groove for positioning the limiting structure;

thereby, a user can assemble the lamp rod by inserting it into the lamp seat easily, the lamp is detachable for storage and transfer with a smaller volume.

2. The detachable lamp assembled device as claimed in claim 1, wherein a bottom of the wire winding box near the lamp seat has through holes, and a bottom of the lamp seat is protruded with a locking seat with a configuration corresponding to the through holes of the wire winding box, thereby a plurality of second studs pass through the through hole from a lower end of the wire winding box and then is locked to the locking seat so as to fix the lamp seat to the wire winding box.

3. The detachable lamp, assembled device as claimed in claim 1, wherein an upper cover of the wire winding box has a limiting piece extending downwards from the upper cover, and a cambered slot is formed on the wire winding box at a position coupling to the limiting piece; and a lower edge of the limiting piece coupling to the lamp rod has a cambered groove.

4. The detachable lamp assembled device as claimed in claim 1, wherein an upper cover of the wire winding box has a buckling portion extending outwards and capable of being buckled to an edge of the lamp rod when the buckling portion is engaged to the wire winding box.

5. The detachable lamp assembled device as claimed in claim 1, wherein an inner edge of the upper cover is installed with a plurality of blocks which are arranged along an annular shape.

6. A detachable lamp assembled device comprising a lamp seat firmly secured to a lateral side of a wire winding box, and a lamp rod inserted into the lamp seat; wherein a lateral side of the wire winding box having a via hole a buckling hole is formed in the lamp seat and penetrated two sides of the lamp seat; a buckling pin is placed in the buckling hole; a reed is locked below the buckling hole by a first stud and one free end of the reed is inserted into the buckling hole; thereby, the buckling pin is limited in the buckling hole so as to position the lamp rod; and a front end of the lamp rod is formed with an end portion for being inserted into the inserting seat; after the lamp rod is inserted, the end portion is inserted into the inserting seat simultaneously; thereby, the lamp seat is conductive to the lamp rod; a portion of the lamp rod near the end portion has an inclined surface; thereby, the end portion can be inserted into the inserting seat easily; and a top of the lamp rod has, a groove for positioning the limiting structure;

thereby, a user can assemble the lamp rod by inserting it into the lamp seat easily; thus, the lamp is detachable for storage and transfer with a smaller volume.

7. The detachable lamp assembled device as claimed in claim 6, wherein a bottom of the wire winding box near the lamp seat has through holes, and a bottom of the lamp seat is protruded with a locking seat with a configuration corresponding to the through holes of the wire winding box, thereby a plurality of second studs pass through the through hole from a lower end of the wire winding box and then is locked to the locking seat so as to fix the lamp seat to the wire winding box.

8. The detachable lamp assembled device as claimed in claim 6, wherein an inner edge of the upper cover is installed with a plurality of blocks which are arranged along an annular shape.

* * * * *